United States Patent [19]

Gibson

[11] Patent Number: 4,695,485

[45] Date of Patent: Sep. 22, 1987

[54] FLUID DISPENSING PROCESS

[75] Inventor: Jame D. M. Gibson, Ilkley, England

[73] Assignee: Wool Development International, Ltd., West Yorkshire, England

[21] Appl. No.: 838,136

[22] Filed: Mar. 10, 1986

Related U.S. Application Data

[62] Division of Ser. No. 645,440, Aug. 29, 1984, Pat. No. 4,607,589.

[30] Foreign Application Priority Data

Sep. 1, 1983 [GB] United Kingdom ..... 8323484
Oct. 10, 1983 [GB] United Kingdom ..... 8327055

[51] Int. Cl.[4] ..... B05D 5/00

[52] U.S. Cl. ..... 427/256; 427/176; 427/285; 427/288; 427/389.9

[58] Field of Search ..... 118/239; 427/389.9, 427/288, 256, 285, 1 L, 176

[56] References Cited

U.S. PATENT DOCUMENTS

| | | | |
|---|---|---|---|
| 2,841,315 | 7/1958 | Paris | 223/73 X |
| 3,218,187 | 11/1965 | Wade, Jr. | 118/211 |
| 3,965,851 | 6/1976 | Cohn | 118/1 |
| 3,994,643 | 11/1976 | Joslin et al. | 118/239 X |
| 4,180,606 | 12/1979 | Hance et al. | 118/239 X |
| 4,268,982 | 5/1981 | Andersen | 223/73 X |
| 4,325,324 | 4/1982 | Kannegiesser | 118/642 |
| 4,342,409 | 8/1982 | Bröllos | 223/73 |
| 4,371,102 | 2/1983 | Engelbart | 223/73 |
| 4,437,246 | 3/1984 | Sanko | 38/25 |
| 4,479,313 | 9/1983 | Frushtick | 223/73 |
| 4,479,314 | 9/1983 | Frushtick | 223/73 |
| 4,538,370 | 9/1983 | Frushtick | 223/73 |

FOREIGN PATENT DOCUMENTS 1603252 11/1981 United Kingdom .

*Primary Examiner*—Thurman K. Page
*Attorney, Agent, or Firm*—Bert J. Lewen; Henry Sternberg

[57] ABSTRACT

An apparatus for the application of crease setting composition comprises at least one movable arm 12 capable of insertion into a leg of a pair of trousers to be creased, the arm carrying at, or near, one end thereof an applicator head 20 comprising a nozzle 22 for the application of crease setting composition and guide means 24 for locating the nozzle within the crease to be treated. Means are provided, for example, a pump or compressed air, for urging crease setting composition through the nozzle into the crease to be set in timed relationship with the relative movement between the applicator head 20 and the trousers 34. A method of operation is also disclosed.

4 Claims, 11 Drawing Figures

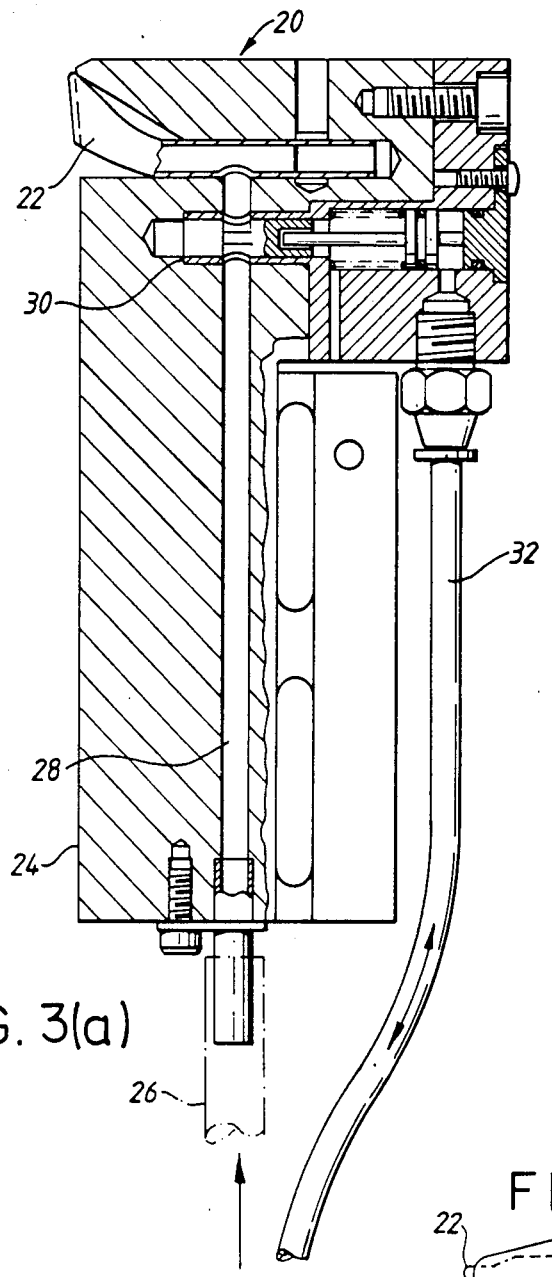
FIG. 3(a)
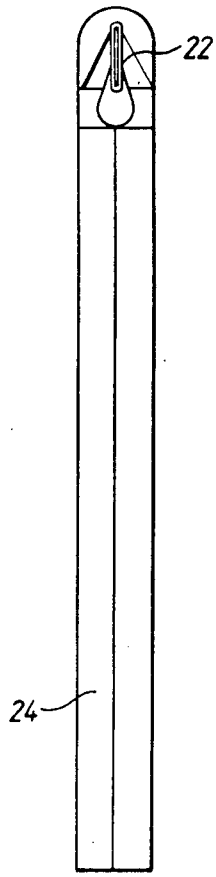
FIG. 3(c)
FIG. 3(b)
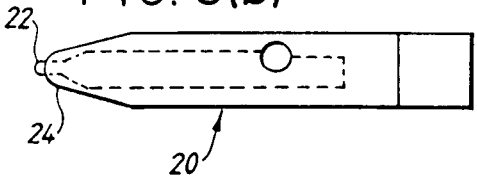

FLUID DISPENSING PROCESS

This is a divisional of co-pending application Ser. No. 645,440 filed on Aug. 29, 1984 and now U.S. Pat. No. 4,607,589.

This invention relates to a fluid dispensing apparatus for crease setting compositions.

In our UK Pat. No. 1603252 and European Patent Publication No. 67528A there are disclosed forms of applicator for applying a crease setting composition to the crease line of garments, for example trousers. The applicators are designed for hand use, and the trousers are first of all turned inside out to expose the interior of the crease line and are then placed on a former, for example as disclosed in UK Pat. No. 1580192.

While the above is excellent for batch application, for example in dry cleaners' shops, it has not hitherto been possible to automate the process to enable it to be used in, for example, trouser production in a factory.

The invention seeks to provide an apparatus which automates the application of crease setting resins to trousers and which may be used in continuous production.

In accordance with the present invention there is provided an apparatus for the application of crease setting compositions which comprises at least one movable arm capable of insertion into a leg of a pair of trousers to be creased, the arm carrying at, or near, one end thereof an applicator head comprising a nozzle for the application of crease setting composition, and guide means for locating the nozzle within the crease to be treated, there being means for urging crease setting composition through the nozzle into the crease to be set in timed relationship with relative movement between the applicator head and the trousers.

Preferably there is at least one pair of arms, movable towards and away from one another, and each arm carries an applicator head. The arms are preferably pivotally mounted at their ends remote from the applicator head and are moved or allowed to move away from one another so that the applicator heads on each respective arm contact opposite creases within a trouser leg.

The guide means may be a guide fin, and is preferably located on the applicator head; but separate internal or external guide means may be used additionally or instead, for example, a guide channel externally of the trousers locating the crease and guiding the nozzle therein. The applicator head is preferably pivotally attached to the end of its respective arm so that the guide fin and applicator nozzle can align accurately within the crease of the trouser being treated. The crease setting composition may be held in a reservoir associated with each applicator head but, for reasons of lack of space, it is preferred that the reservoir of crease setting agent is held remote from the applicator heads and fed thereto by suitable pipe and pump means.

The apparatus is preferably mounted vertically, and in use, the trousers would be lowered over the arms, and the latter would be of a length sufficient to ensure that the applicator heads were at the top of the crease to be treated. The arms would be moved apart locating the applicator heads within the opposite creases, and the trousers moved upwardly drawing the applicator heads down the crease lines on each side of the trouser leg. The pumping of adhesive through the applicator nozzle is arranged to be in timed relationship with the linear movement of the trouser so that a constant, predetermined linear quantity of crease setting agent is deposited within the crease.

In order that application of crease setting agent should be shut off promptly when a crease line has been treated, and that the application of crease setting agent should start promptly at the beginning of a crease, it is preferred to have shut off valve means within the applicator head itself as close as possible to the applicator nozzle. Such valve means may be electrically actuated, but we have found that hydraulic or pneumatic actuation, especially the latter, is preferably in practice.

The applicator nozzle may be very similar to the nozzles used with the hand applicators and described in our earlier patents referred to above. The nozzles would generally have an elongate or 'fishtail' outlet allowing the adhesive to be accurately placed in the centre of the crease line.

The guide fin in the applicator head locates the centre of the crease line and ensures that the orientation of the applicator nozzle is correct. The guide fin may be in the form of an elongated straight edge which fits within the crease line and, preferably precedes the applicator nozzle. The length of the guide fin will vary for different end uses, depending on such factors as the textile material being treated, the heaviness and/or flexibility of the trouser material, and so forth.

Conveniently, the apparatus of the invention will be employed together with a cooperating mechanism capable of lowering the trousers on to the apparatus of the invention and removing therefrom after the crease setting agent has been applied. Such a mechanism will advantageously be connected to a conveyor so that a continuous stream of trousers can be treated. Also the apparatus of the invention will normally be provided in pairs so that both trouser legs can be treated simultaneously. Naturally, banks of greater numbers can be employed allowing more than one pair of trousers to be treated at a given time.

The invention further provides a process for the application of crease setting composition which comprises providing a pair of trousers supported on a conveyor, moving the trousers over an apparatus capable of applying crease setting composition into the crease lines within the trouser legs, removing the trousers from the apparatus thereby causing the crease setting composition to be deposited in the crease lines, conveying the trousers to a subsequent work station, and repeating the process in a continuous manner.

The apparatus capable of applying crease setting composition is preferably that described herein above. The trousers are conveniently conveyed hanging down from a conveyor supported by the bottoms of the legs, and are then lowered on to and removed upwardly from the apparatus, before passing to a subsequent treatment or packing station.

The invention will be described further, by way of example, with reference to the accompanying drawings, in which:

FIG. 3 illustrates one form of applicator head;

Figure 1:
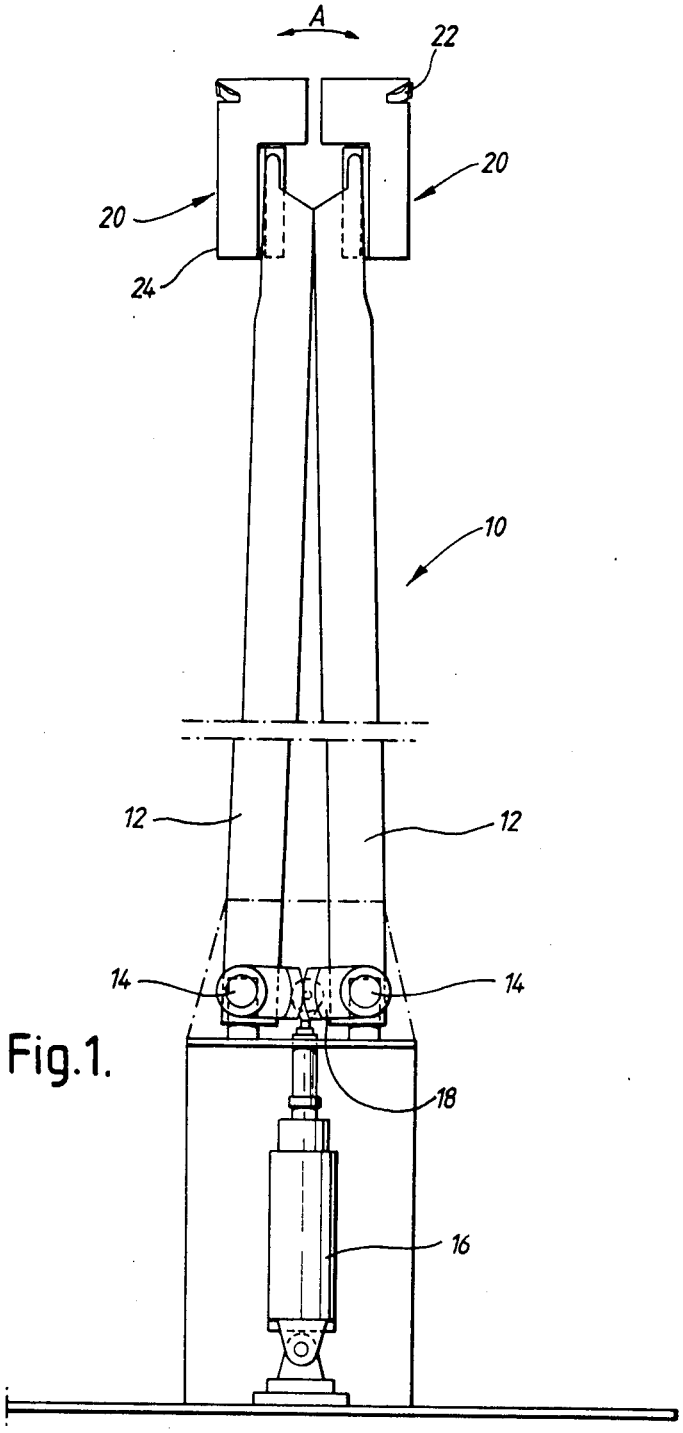
FIG. 1 is a diagrammatic elevational view of an apparatus as constructed in accordance with the invention.
Figure 2:
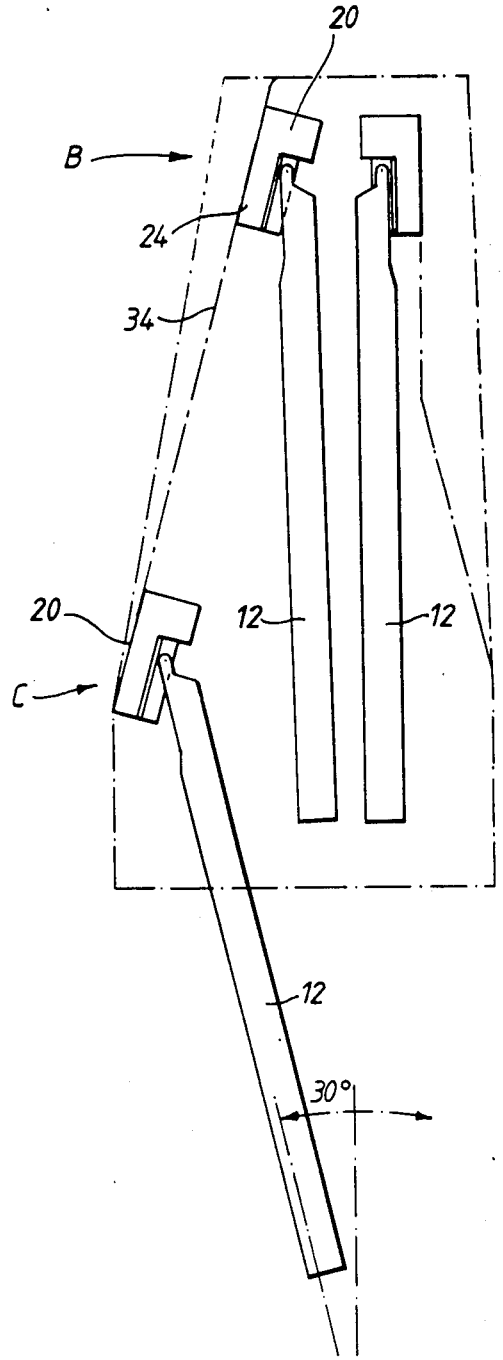
FIG. 2 is a partial view similar to FIG. 1 showing the orientation of the arms at different parts of the creasing cycle.
Figure 4C:
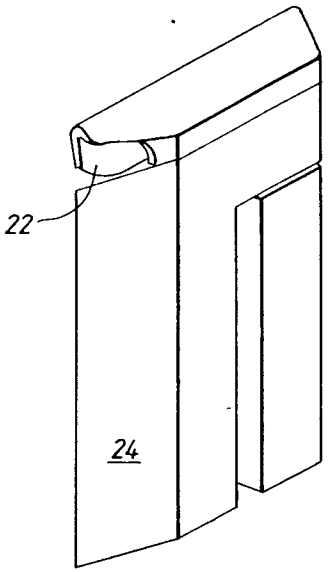
FIG. 4 illustrates another form of applicator head.
Figure 4D:
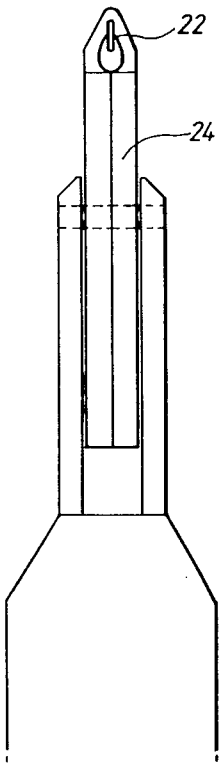
Figure 4A:
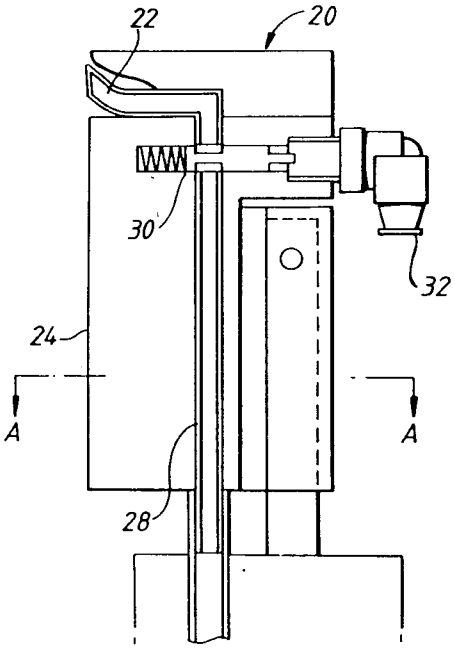
Figure 4B:
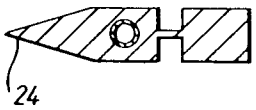

Referring to the drawings, an apparatus generally designated 10 for applying crease setting agent comprises a pair of arms 12 pivotally mounted at 14 for movement towards and away from another as illustrated by arrow A in FIG. 1. The movement is actuated by means of an hydraulic or pneumatic cylinder 16 connected by levers 18 to the arms 12. The normal range of movement of the arms 12 is illustrated in FIG. 2 and is approximately 30° of arc.

At the upper extremities of each arm 12 there is provided an applicator head 20. The applicator head 20 includes an applicator and nozzle 22 and a guide fin 24.

FIG. 3 illustrates in more detail one form of applicator head 20 from which it can be seen that crease setting agent is fed via a tube 26 through a bore 28 within the head 20 to the nozzle 22. A shut-off valve 30 is provided and the latter is actuated by compressed air fed through a second tube 32 and remotely controlled to shut off the feed of crease setting agent to the nozzle 22.

FIG. 4 illustrates a further applicator head 20 which has constructional differences but is nevertheless functionally equivalent to that described with reference to FIG. 3, and in which like figures denote like parts.

In use, a trouser leg, waist portion downwards, is lowered over the apparatus 10 in the position illustrated in FIG. 1 until the bottom end of the crease line is level with the applicator nozzles 22. The arms 12 are pivotted away from one another to the position illustrated by arrow B in FIG. 2 at which the applicator head 20 contacts the inside of the trouser crease line 34 locating within it and thereby orienting the nozzle 22. Pressure is maintained on the arms 12 urging the heads into the crease lines 34 and simultaneously the trousers are withdrawn upwardly. The guide fin 24 ensures that the head 20 accurately follows the crease line and the nozzle 22 deposits an accurately predetermined quantity of crease setting agent within the crease line. Once the trousers reach the position illustrated by arrow C in FIG. 2 the arms 12 retract to their upright position and supply of crease setting agent is shut off, for example by means of the valve 30. The next pair of trousers may then be lowered into position.

Figure 5:
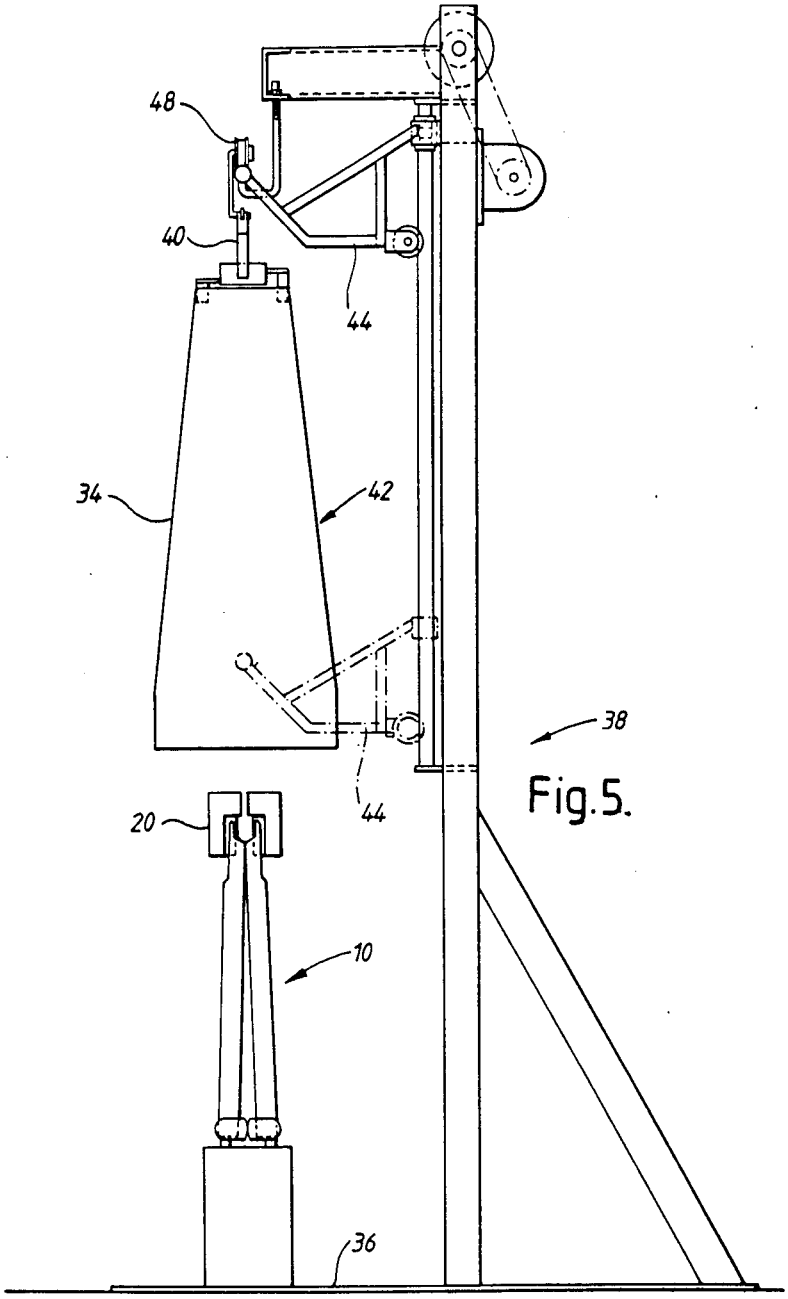
FIG. 5 is an elevational view of a mechanism for supplying trousers to and from the apparatus.

FIG. 5 illustrates a suitable mechanism for use in conjunction with the apparatus of the invention in the continuous treatment of trousers. Two sets of the apparatus of the invention 10 are located (one behind the other) on the base 36 of a framework 38 below a hanger 40 capable of gripping trousers 42 adjacent their lower cuffs. The trousers are then lowered by the mechanism 44 to the position shown in dotted lines in FIG. 5 at which point the applicator heads 20 of the apparatus 10 are adjacent the top of the creases 34 to be treated, one apparatus 10 within each trouser leg. The application of crease setting agent is then carried out as described above with the mechanism 44 being lifted in timed relationship to the application of crease setting agent by means of a pump (not shown) to the applicator heads 20. The hangers 40 run on wheels 48 and the pair of trousers which has been treated is then moved off to its next work station and is replaced by the next pair of untreated trousers. It will be apparent that this process can be operated automatically or semi automatically with a minimum of operator supervision.

The application of crease setting agent in timed relationship with the movement of the applicator head 20 in the crease line 34 may be carried out by means known per se. For example, the pump mechanism may be geared to the mechanism which lifts the trousers over the applicator heads 20, or preferably there may be electrical control signal from the lifting means to the pumping means whereby the two can be controlled in timed relationship enabling a predetermined linear density of crease setting agent to be applied in accordance with the teachings of our earlier patents referred to above. The accurate application of a predetermined linear density of crease setting agent is critical to ensure proper crease setting while at the same time avoiding 'strike-through' of the adhesive to the front face of the fabric, as discussed in our earlier patents referred to above.

While in the preferred embodiment described above the guide fin is separate from its respective arm, it will be appreciated that the invention extends to the case in which a guide fin is integral with the arm and/or the nozzle. It will also be appreciated that guidance means are required in order for the setting composition accurately to follow the line of the crease, and a guide fin is the currently preferred form of such guidance means.

The guide fin 24 preferably has some horizontal resilience with respect to the arms to aid proper location within the crease lines.

Figure 6:
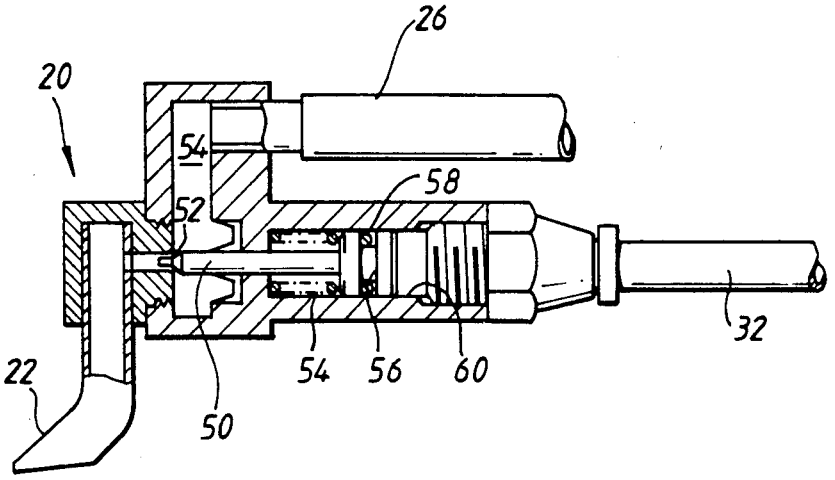
FIG. 6 is a further form of applicator head with the guide fin removed for clarity.

In FIG. 6 is illustrated another applicator head incorporating a shut-off valve similar to the valve 30 described in relation to FIG. 4, but in this case comprising a needle valve 50 and respective valve seat 52 spring-biased at 54 to the open position. Crease setting agent is fed under contact pressure to a chamber 54 via tube 26 as before, and the valve 50 is controlled by compressed air through a second tube 32 to shut off the feed of agent to the nozzle 22. The compressed air acts on a piston 56 carrying O-rings 58 slidably and sealingly located with a bore 60 in the head 20, to overcome the bias of the spring 54 and locate the needle valve 50 in its seat 52 and thereby shut-off flow of the agent to the nozzle 22. The compressed air in line 32 controlled remotely as before in timed relationship with the rest of the apparatus. A guide fin (not shown) may be provided as before.

I claim:

1. A process for the application of a crease setting composition for trousers having legs with crease lines thereon, comprising supporting said trousers on a conveyor, inserting into the leg of said trousers an apparatus capable of forcing outwardly the trouser leg at said crease and applying crease setting composition within said crease line at or near at least one of the points of said outward force, moving the trousers with respect to the apparatus while said outward force is maintained so as to deposit the crease setting composition in said crease line, removing said apparatus from said trouser legs, conveying the trousers to a subsequent work station, and repeating the process in a continuous manner.

2. A method as claimed in claim 1 in which the trousers are conveyed hanging down from a conveyor supported by the bottoms of the legs and are then lowered onto and moved upwardly from the apparatus before passing to the subsequent work station.

3. A method as claimed in claim 1 in which crease setting composition is pumped through the apparatus in timed relationship with the linear movement of the trousers so that a constant predetermined linear quantity of crease setting composition is deposited within the crease.

4. A process for applying a crease setting composition to a pair of trousers, which comprises: supporting said trousers on conveying means and moving said trousers to a work station; inserting into a leg of the trousers to be creased two arms, movable towards and away from one another, at least one of the arms carrying at or near one end thereof an applicator means for the application of crease setting composition; moving said arms away from one another so as to cause one of each arm to contact opposite creases of said trouser leg and guiding said applicator means within the crease to be treated; moving the trousers longitudinally with respect to said applicator means and urging crease setting composition therethrough into the crease in timed relationship with the relative movement between the applicator means and the trousers; moving the arms towards one another after sufficient crease setting composition has been applied; withdrawing the two movable arms from the pants leg, said movable arms being positioned towards one another to facilitate said inserting and withdrawing steps; and conveying the pants leg from said work station.

* * * * *

UNITED STATES PATENT AND TRADEMARK OFFICE

CERTIFICATE OF CORRECTION

PATENT NO. : 4,695,485

DATED : September 22, 1987

INVENTOR(S) : James D. Gibson

It is certified that error appears in the above-identified patent and that said Letters Patent is hereby corrected as shown below:

Cover page, item [75], delete "Jame" and substitute therefor --James--.

Signed and Sealed this

Twenty-third Day of February, 1988

*Attest:*

DONALD J. QUIGG

*Attesting Officer*

*Commissioner of Patents and Trademarks*